United States Patent [19]

Smith

[11] Patent Number: 4,926,735

[45] Date of Patent: May 22, 1990

[54] HEATED ROTATABLE MUSICAL INSTRUMENT STAND

[75] Inventor: Gary Smith, 256 W. 5th Ave., Collegeville, Pa. 19426

[73] Assignees: Mobile Music, Inc., Horsham; Gary Smith, Collegeville; Joseph Stefano, Oreland, all of Pa.

[21] Appl. No.: 305,587

[22] Filed: Feb. 3, 1989

[51] Int. Cl.[5] ..... G10G 5/00

[52] U.S. Cl. ..... 84/453; 84/385 A; 84/387 A

[58] Field of Search ..... 84/327, 385 A, 387 A, 84/421, 453

[56] References Cited

U.S. PATENT DOCUMENTS

| | | | |
|---|---|---|---|
| 3,637,070 | 1/1972 | Friedman | 84/453 X |
| 4,187,947 | 2/1980 | Dunn et al. | 84/327 X |
| 4,304,166 | 12/1981 | Stefano et al. | 84/385 A |
| 4,529,865 | 7/1985 | Oakes | 84/453 X |
| 4,572,050 | 2/1986 | Werner | 84/385 A |

*Primary Examiner*—Lawrence R. Franklin
*Attorney, Agent, or Firm*—Sperry, Zoda & Kane

[57] ABSTRACT

A musical instrument stand which includes a plurality of mounting stations for holding various musical instruments which is rotatable to facilitate a musician changing instruments quickly and which is heated to maintain the temperature of all instruments at the normal operating temperature to improve and control tonal qualities. The instrument stand includes a base with a platform being generally circular and rotatably movable with rerspect to the base. A heat chamber is defined between the platform and the base to act as a reservoir for heated air. A heating device is adapted to heat air which is transported into the air chamber. Instrument support members are attachable with respect to mounting stations defined on the platform. Attachment of a support member biases a flap to an opened position to allow heated air to flow upwardly to contact the musical instrument for maintaining it at operating temperature.

20 Claims, 3 Drawing Sheets

HEATED ROTATABLE MUSICAL INSTRUMENT STAND

BACKGROUND OF THE INVENTION

1. Field Of The Invention

The present invention deals with the problems of instrument access and intonation which are experienced by musicians who play various woodwind and other instruments such as flugle horns, mellophonium and various types of trumpets such as B flat, C, D, E and piccolo trumpets. Other instruments which can be used with this design include alto and tenor saxophones as well as french horns and valve or slide trombones during a given performance. Such musicians are called "doublers".

A quick access to a new instrument as well as an immediately adjacent location for depositing the currently used instrument is an important aspect of the rotatability of the instrument stand of the present invention. While mounted on the stand the instruments are also warmed to achieve a constant tone quality whether the instrument has just been picked from the stand or whether the instrument has been played for an extended period of time..

2. Background Of The Invention

Various devices have been designed to attempt to achieve a solution to these problems. Examples of such designs are shown in U.S. Pat. No. 1,639,200 patented Aug. 16, 1927 to J. Pitts on a Tobacco Pipe Cleaner; U.S. Pat. No. 2,443,695 patented Jun. 22, 1948 to C. Russell on a Drier For Footwear; U.S. Pat. No. 2,809,441 patented Oct. 15, 1957 to H. Wasserlein on a Smoking Pipe Dryer; U.S. Pat. No. 3,043,017 patented Jul. 10, 1962 to E. Strickland et al on an Article Curing Mechanism; U.S. Pat. No. 3,417,482 patented Dec. 24, 1968 to G. Peet on a Boot And Shoe Dryer; U.S. Pat. No. 3,513,564 patented May 26, 1970 to R. Gramprie on a Garment Boot And Mitten Dryer; U.S. Pat. No. 3,786,576 patented Jan. 22, 1974 to J. Gavlick, Sr. on a Pipe Dryer And Odorizer; U.S. Pat. No. 4,145,950 patented Mar. 27, 1979 to F. Glantz on a Wind Instrument Supporting Stand; U.S. Pat. No. 4,161,131 patented Jul. 17, 1979 to H. Blayman on a Musical Instrument Supporting Stand; U.S. Pat. No. 4,265,030 patented May 5, 1981 to J. Smallegan on an Article Dryer; U.S. Pat. No. 4,293,760 patented Oct. 6, 1981 to H. Smal on an Apparatus For Electrically Heating Hair Curlers; U.S. Pat. No. 4,304,166 patented Dec. 8, 1981 to J. Stefano et al on a Rotatable Musical Instrument Stand; U.S. Pat. No. 4,407,182 patented Oct. 4, 1983 to A. Biasini on a Musical Instrument Stand; U.S. Pat. No. 4,529,865 patented Jul. 16, 1985 to F. Oakes, Jr. on an Electrically Heated Musical Instrument Stand.

SUMMARY OF THE INVENTION

A heated rotatable musical instrument stand is disclosed which includes a base member preferably made from a high strength structural grade thermoplastic material and defining a base inlet therein. A platform member is also included made of similar material and is rotatably mounted to the base member to be capable of rotation while the base member is maintained in the fixed position. The platform and the base member cooperate together to define a heated air chamber therebetween which is adapted to receive warm air from the base inlet and retain the warm air within the chamber for supplying selectively upwardly to positions adjacent instruments retained upon the instrument stand.

The platform further defines a plurality of mounting stations thereon each including a mounting outlet in fluid flow communication with respect to the heated air chamber to receive heated air therefrom such that the air can exit and pass adjacent to an instrument retained upon the specific mounting station for warming thereof for maintaining tone qualities of this instrument. Furthermore the mounting stations each include a mounting aperture means therein adapted to receive an instrument support member mounted thereon. Preferably the instrument support member will each include a mounting stud adapted to stand into the mounting aperture means of the mounting station to be secured therein and facilitate attachment of the instrument support member with respect to the platform member. The platform can be adapted to one or more such mounting stations to receive one or more instrument support members detachably securable thereto.

Each of the instrument support members preferably define an internal flow channel therethrough which is adapted to receive air from the mounting outlet means for warming of both the instrument support member and any instrument mounted thereon A heating means is preferably connected to the base inlet to supply heated air thereto. The heated air is then retained within the heated air chamber until an instrument support member is attached with respect to a mounting station.

Each mounting outlet means includes an outlet closing means positioned thereover which has a steady state position extending in a closed position to prevent air flow therethrough. The outlet closing members are adapted to be urged to the opened position responsive to an instrument support member being attached with respect to a mounting station to allow flow of heated air to the instrument support member and to the internal flow channel defined therein. The outlet closing device preferably comprises a flap means resiliently biased extending over the mounting outlet for closing thereof. A protrusion stud included on the instrument support member is adapted to abut the flap and urge it into an opened position responsive to attachment of the instrument support member with respect to the mounting station. In this manner once an instrument support member is attached to a mounting station the flow of heated air will be initiated once the outlet closing means is opened and in this manner control the temperature of any instrument mounted upon that instrument support member. Preferably the protrusion stud will bias the flap means open whenever the mounting stud of the instrument support member is mounted within the mounting aperture means defined within the mounting station. In this manner heated air will not be wasted since it will not exit from any mounting station unless an instrument support member is actually attached thereto.

To facilitate rotatable movement between the platform member and the base member a ball bearing means may preferably be positioned therebetween. To control the rotational movement a stop means may extend between the base member and the platform member for selectively preventing rotational movement therebetween. A resilient gasket member is preferably positioned at each mounting station between each instrument support member and the platform to facilitate flow of heated air from the mounting outlet to the internal flow chamber without leakage.

To further control the flow of air an arcuate deflector member may be positioned within the air chamber adjacent to the base inlet to guide air flow more evenly throughout the annular air chamber area.

An outrigger member may be included for holding a support member for retaining additional instruments or larger instruments which includes a housing member having an outrigger inlet aperture at one end thereof and an outrigger outlet opening at the opposite end thereof. The housing member also defines an outrigger air flow channel extending between the inlet aperture and the outlet opening. An outlet attachment device is included for securing of the inlet aperture with respect to one of the mounting stations in such a manner as to receive heated air therefrom. Furthermore a leg means is attached with respect to the outrigger member adjacent to the outrigger outlet opening to extend downwardly therefrom for support of the housing. An outrigger mounting device is included similar to the mounting stations defined on the platform of the instrument stand for mounting of one of the instrument support members thereto in a position peripherally displaced from the mounting stations defined on the platform.

It is an object of the present invention to provide a heated rotatable musical instrument stand wherein maintenance costs are minimized.

It is an object of the present invention to provide a heated rotatable musical instrument stand wherein initial capital outlay for equipment is minimized.

It is an object of the present invention to provide a heated rotatable musical instrument stand wherein a great variety of different shapes and contours of instruments can be mounted upon the same mounting stand.

It is an object of the present invention to provide a heated rotatable musical instrument stand wherein alto and tenor saxophones can also be mounted thereon and yet maintain the stability of the instrument stand.

It is an object of the present invention to provide a heated rotatable musical instrument stand wherein a complete system is provided for supporting, accessing and maintaining intonation of one or more woodwind instruments.

It is an object of the present invention to provide a heated rotatable musical instrument stand wherein all components are formed of high quality structural grade thermoplastic material to maintain strength, toughness and heat resistance.

It is an object of the present invention to provide a heated rotatable musical instrument stand wherein the stand is disassemblable and of compact size.

It is an object of the present invention to provide a heated rotatable musical instrument stand wherein very low friction and low noise is encountered between a rotating platform and the stationary base thereunder.

It is an object of the present invention to provide a heated rotatable musical instrument stand wherein quick convenient access to needed straight wind instruments is possible.

It is an object of the present invention to provide a heated rotatable musical instrument stand wherein locking in place to prevent rotation of the upper platform is possible.

It is an object of the present invention to provide a heated rotatable musical instrument stand wherein outriggers can be used for conversion to a combo-type stand for holding tenor and/or alto sax plus up to four or more conventional woodwind instruments.

It is an object of the present invention to provide a heated rotatable musical instrument stand wherein a heat means is provided which can control blower speed and heating temperature for maintaining woodwind instruments at approximate playing temperature and minimizing temperature induced variations in intonation which is a constant problem for any woodwind doubler.

It is an object of the present invention to provide a heated rotatable musical instrument stand wherein a specific system can be custom designed for the uses of a particular musician.

It is an object of the present invention to provide a heated rotatable musical instrument stand wherein quick changeover from one musical instrument to another is achievable for a doubler.

It is an object of the present invention to provide a heated rotatable musical instrument stand wherein viewing of the individual instrument support members is possible under dimly lit conditions.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
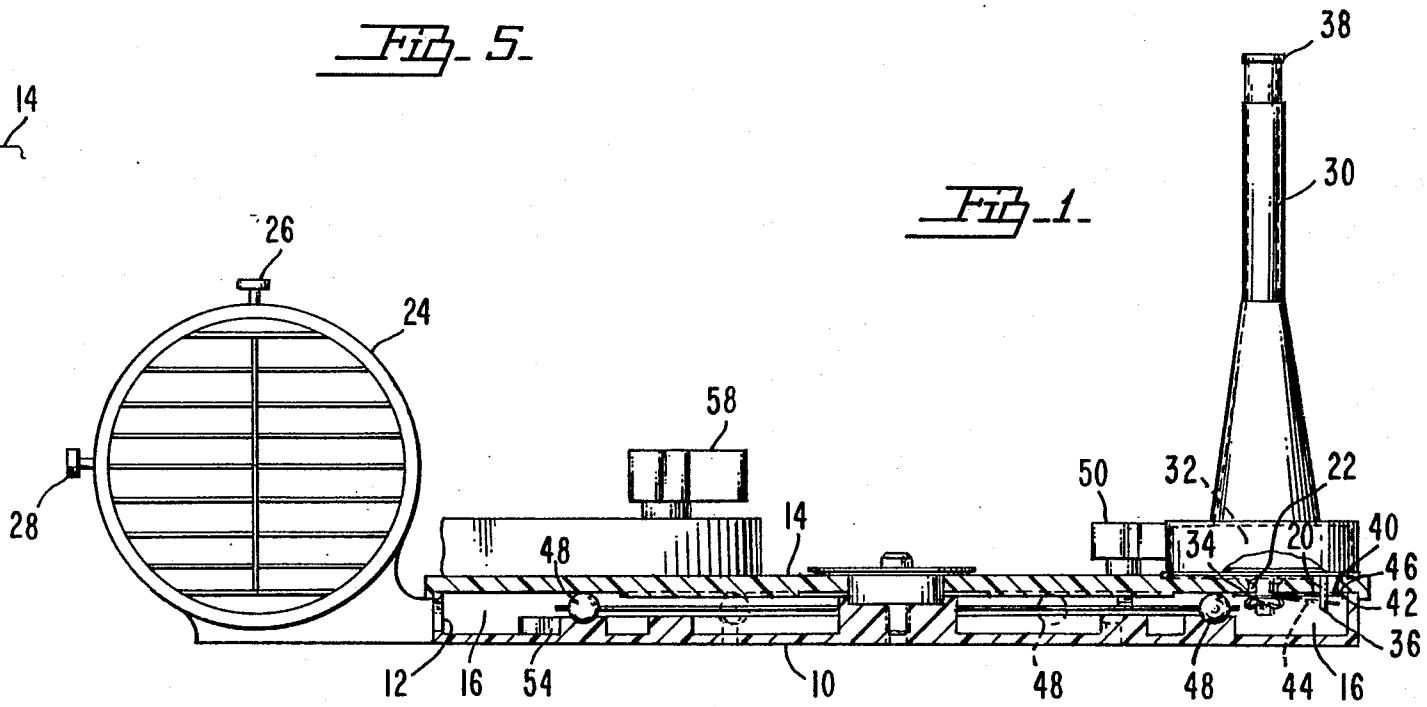
FIG. 1 is a cross sectional view of an embodiment of the heated rotatable musical instrument stand of the present invention.
Figure 5:
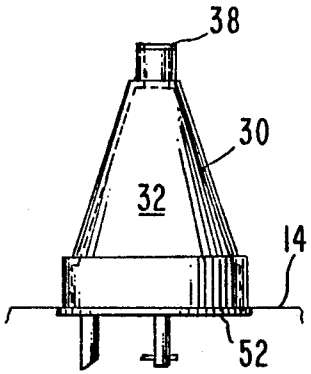
FIG. 5 is an alternative embodiment of an instrument support member for use with the heated musical instrument stand of the present invention.
Figure 4:
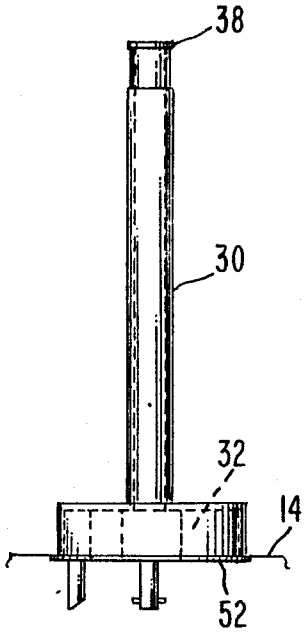
FIG. 4 is a side cross sectional view of one embodiment of a instrument support member.
Figure 2:
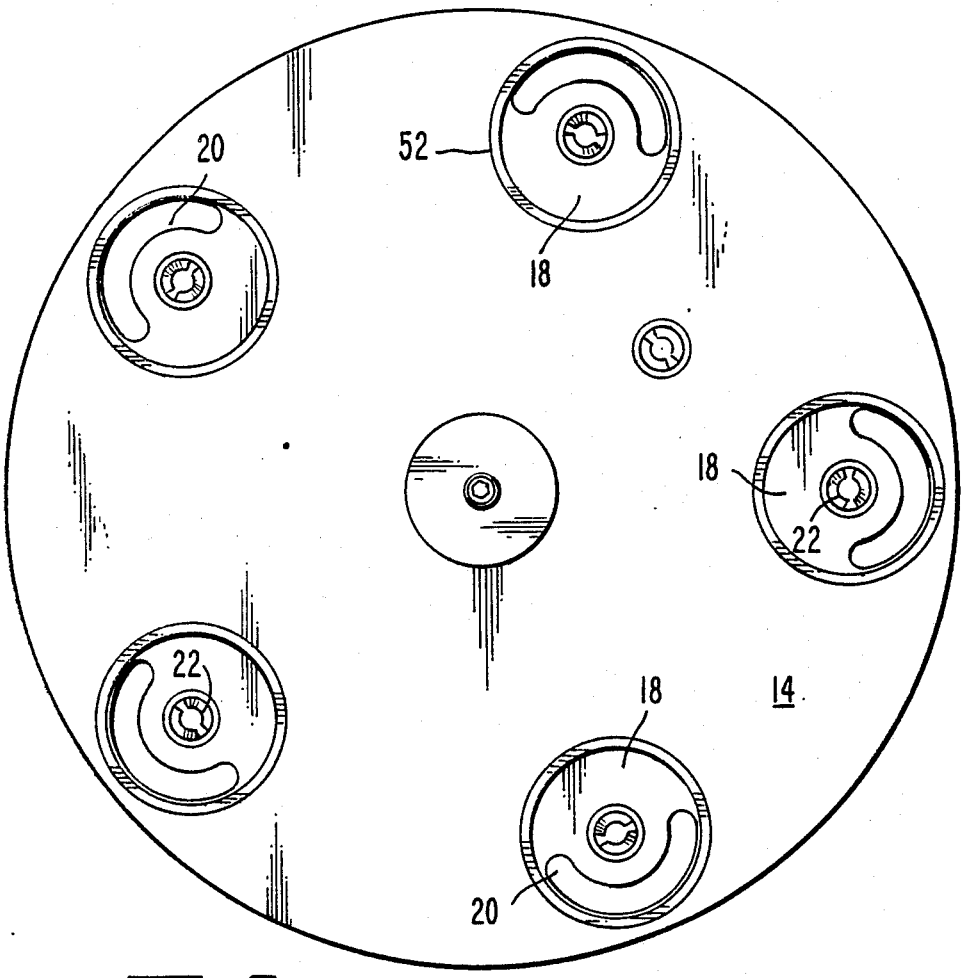
FIG. 2 is a top plan view of an embodiment of a platform means of the heated rotatable musical instrument stand of the present invention.
Figure 7:
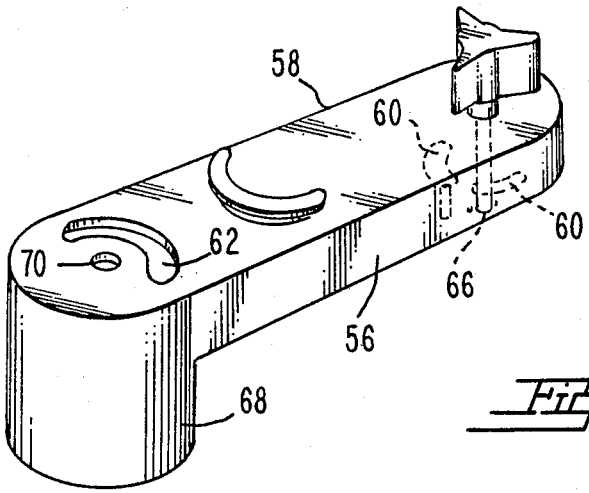
FIG. 7 is a perspective view of an embodiment of an outrigger member for use with the heated musical instrument stand of the present invention.
Figure 3:
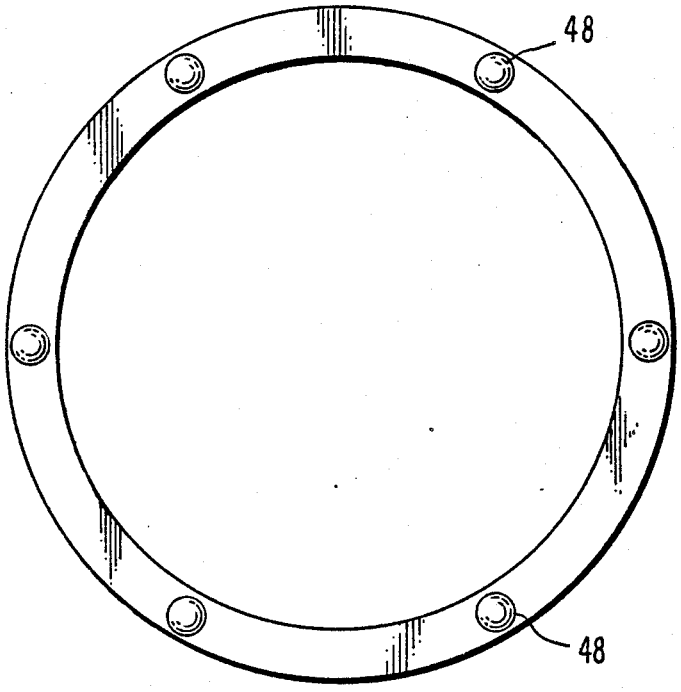
FIG. 3 is a top plan view of an embodiment of the ball bearing member of the heated rotatable musical instrument stand of the present invention.

The present invention provides a heated rotatable musical instrument stand having a base member 10 with a base inlet opening 12 defined preferably in the side thereof. A platform member 14 is rotatably mounted with respect to the base member 10 by way of a bearing means such as a ball bearing means 48 positioned therebetween.

Base member 10 and platform member 14 cooperate together to define a heated air chamber 16 in fluid flow communication with respect to the base inlet 12. A heating means 24 including preferably a temperature control member 26 and a blower control 28 is in fluid flow communication with the base inlet 12 to supply heated air therethrough into the heated air chamber 16.

The platform member 14 preferably defines a plurality of mounting stations 18 along the upper surface thereof. At least one mounting station 18 must be included within an upper surface of a platform member 14. Each mounting station preferably includes a mounting outlet means 20 in fluid flow communication with respect to the heated air chamber 16 to receive warmed air therefrom for release upwardly. Each mounting station also includes a mounting aperture means 22 adapted to facilitate securement of an instrument support member 30 with respect to the mounting station 18. Each mounting station 18 is designed to receive one of a plurality of different instrument support members 30. Each instrument support member 30 includes a mounting stud 34 which is adapted to extend into the mounting aperture means 22 defined within each mounting station 18 and in that manner be detachably secured thereto.

An outlet closing means 40 is positioned adjacent each mounting outlet means 20 in such a manner as to close the outlet in the steady state position. Unless an instrument support member 30 is attached to a specific mounting station 18 the outlet closing means 40 associated therewith will be retained within the closed position 42 thereby preventing the exiting of air from heated air chamber 16 outwardly therethrough.

Each instrument support member 30 includes a protrusion stud 36 preferably extending downwardly therefrom and adapted to abut the outlet closing means 40 to facilitate opening thereof. Preferably outlet closing means 40 takes the form of a flap means 46 which in the steady state position extends across the mounting outlet 20 for closing same when in the steady state closed position 42. Upon mounting of an instrument support member 30 to a mounting station 18 the protrusion stud 32 will extend downwardly and abut the flap means 46. As the mounting stud 34 extends into the mounting aperture means 22 the protrusion stud 36 will move downwardly against flap means 46. Flap means 46 will be caused to move to the opened position 44 upon completion of mounting of instrument support member 30 to the mounting station 18. In this manner the mounting outlet means 20 for that particular mounting station 18 will be held in the opened position 44 to allow heated air to exit upwardly therefrom adjacent to the instrument placed upon that particular instrument support member 30 for maintaining the intonation qualities thereof.

Preferably each instrument support member 30 will include an internal flow channel 32 which will extend throughout the interior of the instrument support member 30 for causing warming of the entire member 30 thereby achieving warming of any instrument mounted thereon.

In dimly lit environments which are quite commonly experienced by musicians it is difficult to see the instruments or the instrument stand. For this reason a fluorescent coloration means 38 is preferably included at some point on the instrument support member 30 to facilitate viewing under these conditions. Furthermore under some circumstances it is desirable to prevent the rotatability of the platform member with respect to the base member and for this means a stop means 50 is selectively positionable between a stopping position preventing rotation and an open position allowing rotation.

To facilitate the flow of heated air from the heated air chamber 16 to the internal flow channel 32 a resilient gasket means 52 is preferably positioned between the upper surface of platform member 14 and the lower surface of the instrument support member 30. In this manner leakage of heated air outwardly prior to passing thereof through the internal flow channel 32 of instrument support member 30 is prevented. To further control air flow an arcuate deflector member 54 may be positioned within the heated air chamber 16 adjacent the base inlet 12.

Figure 6:
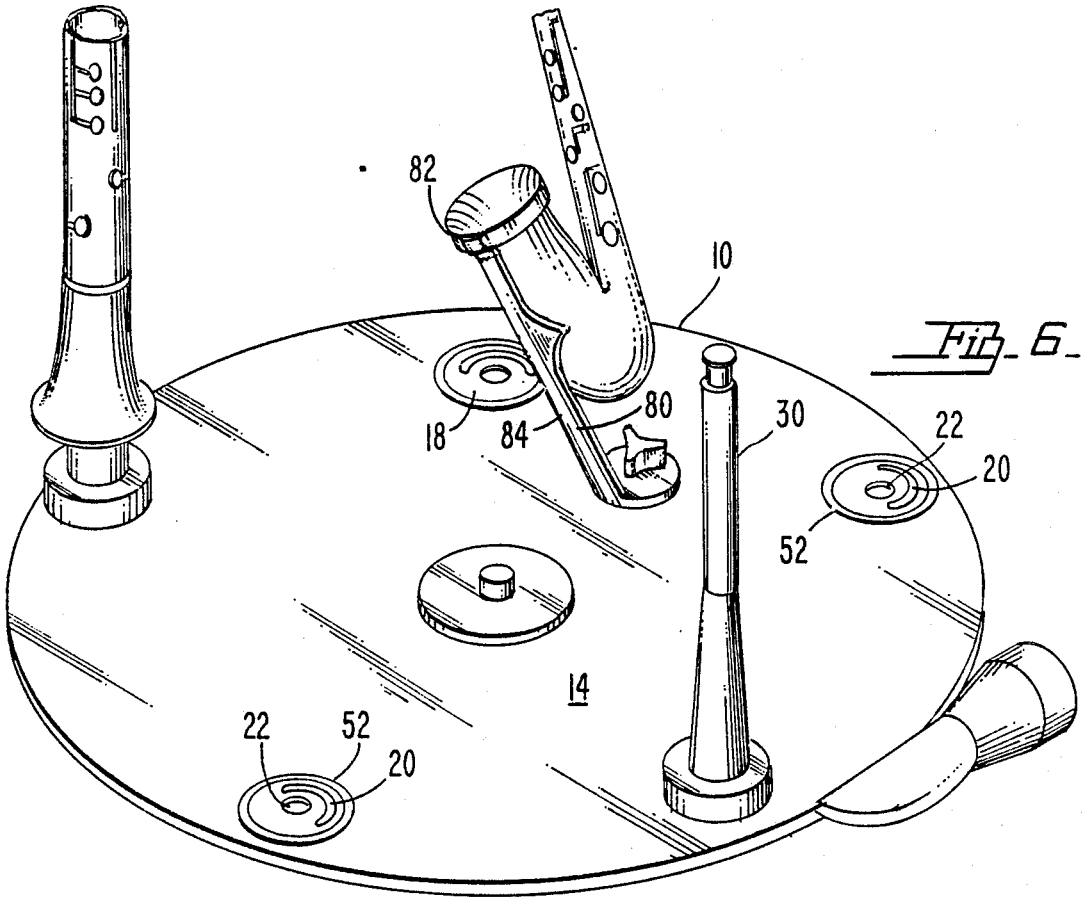
FIG. 6 is a perspective view of an embodiment of the heated musical instrument stand of the present invention.

A different type of supporting arrangement is required for larger instruments such as tenor and alto saxophones. Such a support 80 is shown in FIG. 6. Support 80 takes the general shape of a U-shaped retaining bracket 82 pivotally secured with respect to a support member 84. The U-shaped bracket is adapted to retain the open end of a tenor or alto saxophone as required.

An outrigger member 56 may be included to facilitate simultaneous holding of tenor and alto saxophones or other large instruments. Member 56 may include a housing member 58 defining a housing air flow channel 64 extending therethrough. An outrigger inlet aperture 60 is defined at one end thereof and an outrigger outlet aperture 62 is defined at the upper end thereof in fluid flow communication with respect to one another through the outrigger air flow channel 64.

An outrigger attachment means 66 is adapted to attach the one end of the outrigger with respect to any of the mounting stations on the heated rotatable musical instrument stand and an outrigger leg means 68 is secured to the undersurface of the opposite end thereof to facilitate maintenance of the outrigger housing 58 in a horizontally extending direction. An outrigger mounting means 70 is defined on the outermost upper section thereof to allow a conventionally described instrument support member 30 to be secured thereto In this manner heated air will flow outwardly through the mounting station to which the outrigger is attached and through the outrigger air flow channel and upwardly through the outrigger outlet aperture 62 into the internal flow channel 32 of the instrument support member 30 in the same manner as if that instrument support member were mounted directly to the platform member.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A heated rotatable musical instrument stand comprising:

(a) a base member defining a base inlet therein;

(b) a platform member rotatably mounted with respect to said base member to be separately rotatable with respect thereto, said platform member and said base member cooperating to define a heated air chamber therebetween in fluid flow communication with respect to said base inlet, said platform member further defining a plurality of mounting stations thereon, each mounting station including a mounting outlet means in fluid flow communication with respect to said heated air chamber to allow heated air to exit therefrom;

(c) a heating means in fluid flow communication with respect to said heated air chamber to supply heated air thereto;

(d) at least one instrument support member being detachably attached with respect to said mounting station on said platform member to facilitate retaining of a musical instrument thereon, said instrument support member being positioned adjacent said mounting outlet means to be heated by air exited therefrom, said instrument support member being rotatable with said platform member to facilitate instrument selection; and (e) an outlet closing means positioned adjacent to each of said mounting outlet means and having a steady state closed position extending thereover to close said mounting outlet means and prevent air flow therethrough, said outlet closing means being adapted to be urged to the opened position responsive to said instrument support member being attached with respect to said mounting station to allow flow of heated air to said instrument support member.

2. A heated rotatable musical instrument stand as defined in claim 1 wherein said instrument support member defines an internal flow channel therethrough, said internal flow channel being in fluid flow communication with respect to said mounting outlet means responsive to attachment of said instrument support member with respect to one of said mounting stations, said internal flow channel being adapted to receive heated air therefrom to facilitate heating of a musical instrument retained upon said instrument support member.

3. A heated rotatable musical instrument stand as defined in claim 2 including gasket means positioned between each said instrument support member and each said platform means to facilitate flow of heated air from said mounting outlet means to said internal flow channel.

4. A heated rotatable musical instrument stand as defined in claim 1 further including a bearing means positioned between said base member and said platform member to facilitate rotation therebetween.

5. A heated rotatable musical instrument stand as defined in claim 4 wherein said bearing means comprises a ball bearing member

6. A heated rotatable musical instrument stand as defined in claim 1 further including a stop means extending between said platform means and said base member to selectively prevent rotational movement therebetween.

7. A heated rotatable musical instrument stand as defined in claim 1 wherein said outlet closing means comprises a flap means resiliently biased to a steady state position extending over said mounting outlet means for closing thereof.

8. A heated rotatable musical instrument stand as defined in claim 7 wherein each of said mounting stations defines a mounting aperture means to facilitate detachable securement of said instrument support members with respect to said platform member.

9. A heated rotatable musical instrument stand as defined in claim 8 wherein each of said instrument support members includes a mounting stud adapted to extend into said mounting aperture means to be secured therein to facilitate mounting of said instrument support member to said mounting station.

10. A heated rotatable musical instrument stand as defined in claim 8 wherein said instrument support member includes a protrusion stud adapted to abut said flap means and urge same to an opened position responsive to attachment of said instrument support member with respect to said mounting station to facilitate flow of heated air to said instrument support member.

11. A heated rotatable musical instrument stand as defined in claim 1 further comprising an arcuate deflector member positioned within said air chamber adjacent said base inlet to guide air flow into said air chamber therefrom.

12. A heated rotatable musical instrument stand as defined in claim 1 wherein said instrument support member include luminescent coloration means thereon to facilitate viewing thereof under dimly lit environmental conditions.

13. A heated rotatable musical instrument stand as defined in claim 12 wherein said luminescent coloration means are fluorescent.

14. A heated rotatable musical instrument stand as defined in claim 1 further including a large instrument bracket member for holding larger and heavier instrument, said large instrument bracket being attachable with respect to said platform means.

15. A heated rotatable musical instrument stand as defined in claim 1 further comprising an outrigger member to facilitate retaining of larger instruments, said outrigger member including:

(a) a housing member defining an outrigger inlet aperture at one end thereof and an outrigger outlet opening at the opposite end thereof, said housing member also defining an outrigger airflow channel extending therebetween;

(b) outrigger attachment means for securing said outrigger inlet aperture with respect to one of said mounting stations to receive heated air therefrom;

(c) a leg means attached to said outrigger member adjacent said outrigger outlet opening and extending downwardly therefrom; and (d) an outrigger mounting means for mounting of one of said instrument support member to said outrigger member adjacent said outrigger outlet opening defined therein.

16. A heated rotatable musical instrument stand as defined in claim 1 wherein said base member, said platform member and said instrument support members are made of high strength structural grade thermoplastics.

17. A heated rotatable musical instrument stand as defined in claim 1 wherein said heating means includes temperature adjustment means for controlling the temperature of the heated air supplied to said base inlet.

18. A heated rotatable musical instrument stand as defined in claim 1 wherein said base member is generally circular.

19. A heated rotatable musical instrument stand as defined in claim 1 wherein said platform member defines five mounting stations.

20. A heated rotatable musical instrument stand comprising:

(a) a base member made of high strength structural grade thermoplastic and defining a base inlet therein;

(b) a platform member made of high strength structural grade thermoplastic and rotatably mounted with respect to said base member to be separately rotatable with respect thereto, said platform member and said base member cooperating to define a heated air chamber therebetween in fluid flow communication with respect to said base inlet, said platform member further defining a plurality of mounting stations thereon, each mounting station including a mounting outlet means in fluid flow communication with respect to said heated air chamber to allow heated air to exit therefrom, each of said mounting stations defining a mounting aperture means therein;

(c) a heating means in fluid flow communication with respect to said heated air chamber to supply heated air thereto;

(d) at least one instrument support member made of high strength structural grade thermoplastic and being detachably attached with respect to said mounting station on said platform member to facilitate retaining of a musical instrument thereon, said instrument members being positioned adjacent said mounting outlet means to be heated by air exited therefrom, said instrument support member being rotatable with said platform member to facilitate instrument selection, each of said instrument support members defining an internal flow channel therethrough, said internal flow channel being in fluid flow communication with respect to said mounting outlet means responsive to attachment of said instrument support member with respect to one of said mounting stations, said internal flow channel being adapted to receive heated air therefrom to facilitate heating of a musical instrument retained upon said instrument support member, each of said instrument support members including a mounting stud adapted to extend into said mounting aperture means of said mounting station to be secured therein to facilitate mounting of said instrument support member to said platform member, each said instrument support member including a protrusion stud thereon, said instrument support member including fluorescent coloration means thereon to facilitate viewing thereof under dimly lit environmental conditions;

(e) an outlet closing means positioned adjacent to each of said mounting outlet means and having a steady state closed position extending thereover to close said mounting outlet means and prevent air flow therethrough, said outlet closing means being adapted to be urged to the opened position responsive to said instrument support member being attached with respect to said mounting station to allow flow of heated air to said instrument support member, said outlet closing means comprises a flap means resiliently biased extending over said mounting outlet means for closing thereof, said protrusion stud of said instrument support member being adapted to abut said flap means and urge same to an opened position responsive to attachment of said instrument support member with respect to said mounting station to initiate flow of heated air to said instrument support member;

(f) ball bearing means located between said base member and said platform member to facilitate rotational movement therebetween;

(g) a stop means extending between said base member and said platform member for selectively preventing rotational movement therebetween;

(h) resilient gasket means positioned between each said instrument support member and each said platform means to facilitate flow of heated air from said mounting outlet means to said internal flow channel;

(i) an arcuate deflector member positioned within said air chamber adjacent said base inlet to guide air flow into said air chamber therefrom;

(j) an outrigger member made of high strength structural grade thermoplastic adapted to retain larger instruments, said outrigger member comprising:

(1) a housing member defining an outrigger inlet aperture at one end thereof and an outrigger outlet opening at the opposite end thereof, said housing member also defining an outrigger airflow channel extending therebetween;

(2) outrigger attachment means for securing said outrigger inlet aperture with respect to one of said mounting stations to receive heated air therefrom;

(3) a leg means attached to said outrigger member adjacent said outrigger outlet opening and extending downwardly therefrom; and (4) an outrigger mounting means for mounting of one of said instrument support members to said outrigger member adjacent said outrigger outlet opening defined therein.

* * * * *